US012543861B2

(12) United States Patent
Wu

(10) Patent No.: US 12,543,861 B2
(45) Date of Patent: Feb. 10, 2026

(54) SEAT WITH HEALTH MONITORING FUNCTION

(71) Applicant: Shanghai Wudi Home Furnishings Co Ltd, Shanghai (CN)

(72) Inventor: Peng Wu, Shanghai (CN)

(73) Assignee: Shanghai Wudi Home Furnishings Co Ltd, Shanghai (CN)

( * ) Notice: Subject to any disclaimer, the term of this patent is extended or adjusted under 35 U.S.C. 154(b) by 105 days.

(21) Appl. No.: 18/523,950

(22) Filed: Nov. 30, 2023

(65) Prior Publication Data

US 2025/0057319 A1 Feb. 20, 2025

(30) Foreign Application Priority Data

Aug. 17, 2023 (CN) ..... 202322222405.7

(51) Int. Cl.
*A47C 15/00* (2006.01)
*A47C 31/00* (2006.01)
*A47C 31/12* (2006.01)

(52) U.S. Cl.
CPC ..... *A47C 15/004* (2013.01); *A47C 31/008* (2013.01); *A47C 31/12* (2013.01)

(58) Field of Classification Search
CPC ..... A47C 15/00; A47C 15/004; A47C 29/00; A47C 31/00; A47C 31/008; A47C 31/12; A47C 31/126
See application file for complete search history.

(56) References Cited

U.S. PATENT DOCUMENTS

| | | | | |
|---|---|---|---|---|
| 7,163,263 | B1 * | 1/2007 | Kurrasch | A47C 31/008 297/217.3 |
| 7,461,896 | B2 * | 12/2008 | Welles | A61G 5/14 297/DIG. 10 |
| 9,730,918 | B2 * | 8/2017 | Bollag | A61K 45/06 |
| 11,786,040 | B1 * | 10/2023 | Porter | A47C 7/727 297/217.4 |
| 12,285,371 | B2 * | 4/2025 | Wang | A61G 5/14 |
| 2006/0103209 | A1 * | 5/2006 | Olcheski | A61G 5/14 297/330 |
| 2008/0007103 | A1 * | 1/2008 | Welles | A61B 5/6887 297/330 |
| 2014/0265502 | A1 * | 9/2014 | Hough | A47C 1/024 280/47.38 |
| 2017/0105540 | A1 * | 4/2017 | Jacobs | A47C 4/06 |
| 2017/0135490 | A1 * | 5/2017 | Andrix | H02J 50/90 |
| 2019/0380896 | A1 * | 12/2019 | Wang | A47C 1/0244 |
| 2022/0400868 | A1 * | 12/2022 | Nelson | A47C 7/725 |

* cited by examiner

*Primary Examiner* — Chi Q Nguyen
(74) *Attorney, Agent, or Firm* — Bayramoglu Law Offices LLC

(57) ABSTRACT

A seat with a health monitoring function is provided. The seat with a health monitoring function includes a seat body, a seat power supply box, and a detection module, where the seat body is provided with the seat power supply box; and the seat power supply box is provided with the detection module and a control button.

9 Claims, 5 Drawing Sheets

SEAT WITH HEALTH MONITORING FUNCTION

CROSS REFERENCE TO THE RELATED APPLICATIONS

This application is based upon and claims priority to Chinese Patent Application No. 202322222405.7, filed on Aug. 17, 2023, the entire contents of which are incorporated herein by reference.

TECHNICAL FIELD

The present disclosure relates to the field of health monitoring devices, and in particular to a seat with a health monitoring function.

BACKGROUND

Nowadays, cardiovascular and cerebrovascular diseases frequently occur in the elderly. Besides, due to excessive stress, unhealthy diet, lack of exercise, and insufficient sleep, the sub-health problems of white-collar workers are becoming increasingly severe. People who experience these problems often use seats such as sofas or chairs for extended periods of time. Therefore, in order to facilitate health monitoring of these people during sitting on seat, a seat with a health monitoring function is needed.

SUMMARY

In view of defects in the prior art, an objective of the present disclosure is to provide a seat with a health monitoring function.

The seat with a health monitoring function according to the present disclosure includes a seat body, a seat power supply box, and a detection module, where the seat body is provided with the seat power supply box; and the seat power supply box is provided with the detection module.

Preferably, the seat power supply box includes: a power supply box housing, a chip and motherboard module, and a power supply box base plate; and the power supply box housing is connected to the power supply box base plate and forms a chamber therein; the chip and motherboard module is provided in the chamber; and the detection module is provided on the chip and motherboard module.

Preferably, the power supply box housing is provided with a detection hole; and the detection module is facing the detection hole.

Preferably, the detection hole is located in a center of the seat power supply box.

Preferably, the seat body is provided with a seat pocket; and the seat power supply box in a storage state is placed in the seat pocket.

Preferably, the chip and motherboard module is connected to a power supply of the seat body.

Preferably, the detection module is provided with a light source and a light source sensor; and light emitted by the light source to a capillary is reflected to the light source sensor through a capillary pulsation.

Preferably, when the seat body is a chair, the seat power supply box is a speaker power supply box provided on the chair. When the seat body is a sofa, the seat power supply box is a controller provided on the sofa.

Preferably, the power supply box housing is provided with a button hole; the chip and motherboard module is provided with a control button; and the control button is facing the button hole.

Compared with the prior art, the present disclosure has the following beneficial effects:

1. The present disclosure adds the detection module to a power supply module of the seat, offering a health monitoring function to traditional chairs or massage sofas without adding other components.
2. The present disclosure avoids the need to purchase a seat and a detection device simultaneously, thereby reducing costs.
3. The present disclosure is more convenient than ordinary detection devices, and can achieve health monitoring at any time during home or office life.

BRIEF DESCRIPTION OF THE DRAWINGS

Other features, objectives, and advantages of the present disclosure will become more apparent by reading the detailed description of non-limiting embodiments with reference to the following drawings.

REFERENCE SIGNS

| | |
|---|---|
| 1. seat body; | 25. detection module; |
| 2. seat power supply box; | 251. light source; |
| 21. power supply box housing; | 252. light source sensor; |
| 22. chip and motherboard module; | 26. button hole; |
| 23. power supply box base plate; | 27. control button; and |
| 24. detection hole; | 3. seat pocket. |

DETAILED DESCRIPTION OF THE EMBODIMENTS

The following describes the present disclosure in detail in conjunction with particular embodiments. The following embodiments will be conducive to further understanding of the present disclosure by a person of ordinary skill in the art, but does not limit the present disclosure in any form. It should be noted that several variations and improvements can also be made by a person of ordinary skill in the art without departing from the conception of the present disclosure. These variations and improvements shall fall within the protection scope of the present disclosure.

Figure 1:
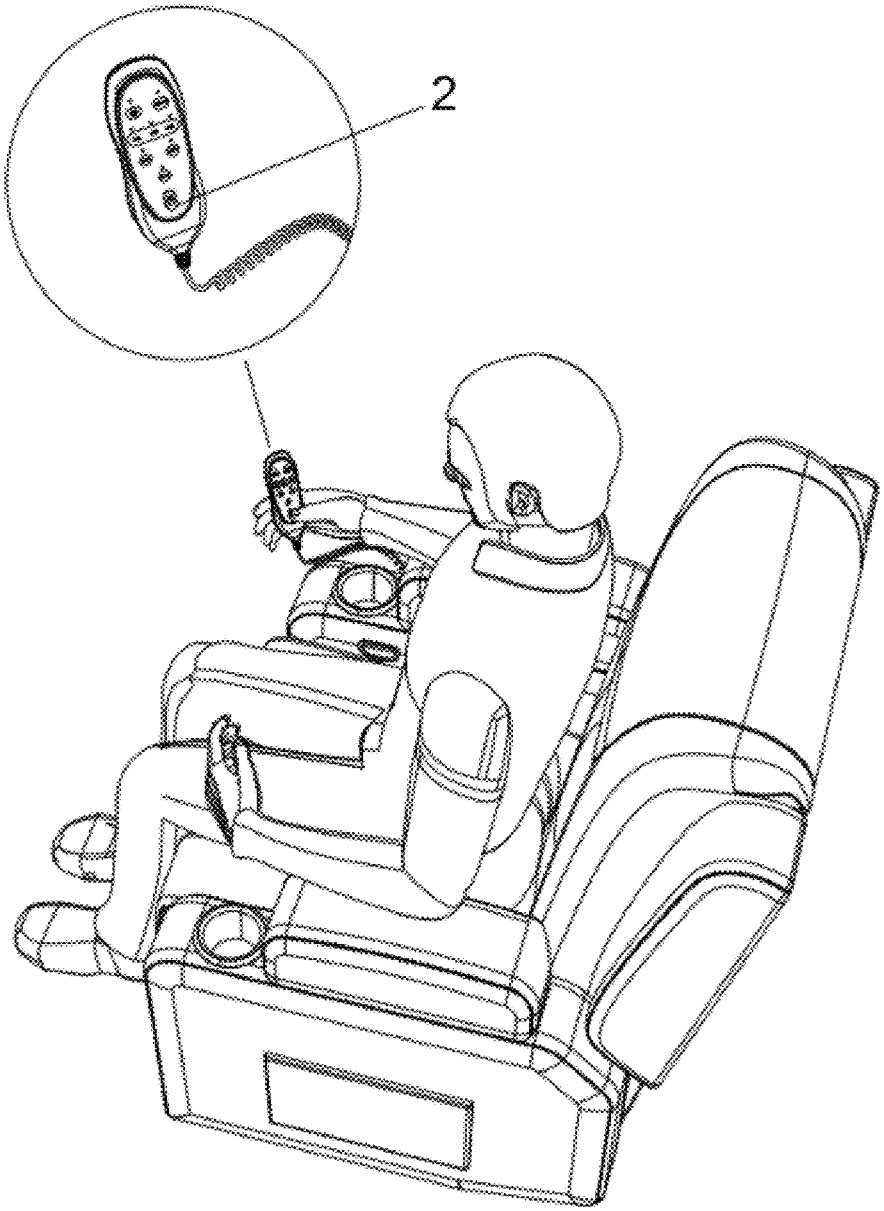
FIG. 1 is a schematic diagram of a seat with a health monitoring function in a working state according to the present disclosure.
Figure 2:
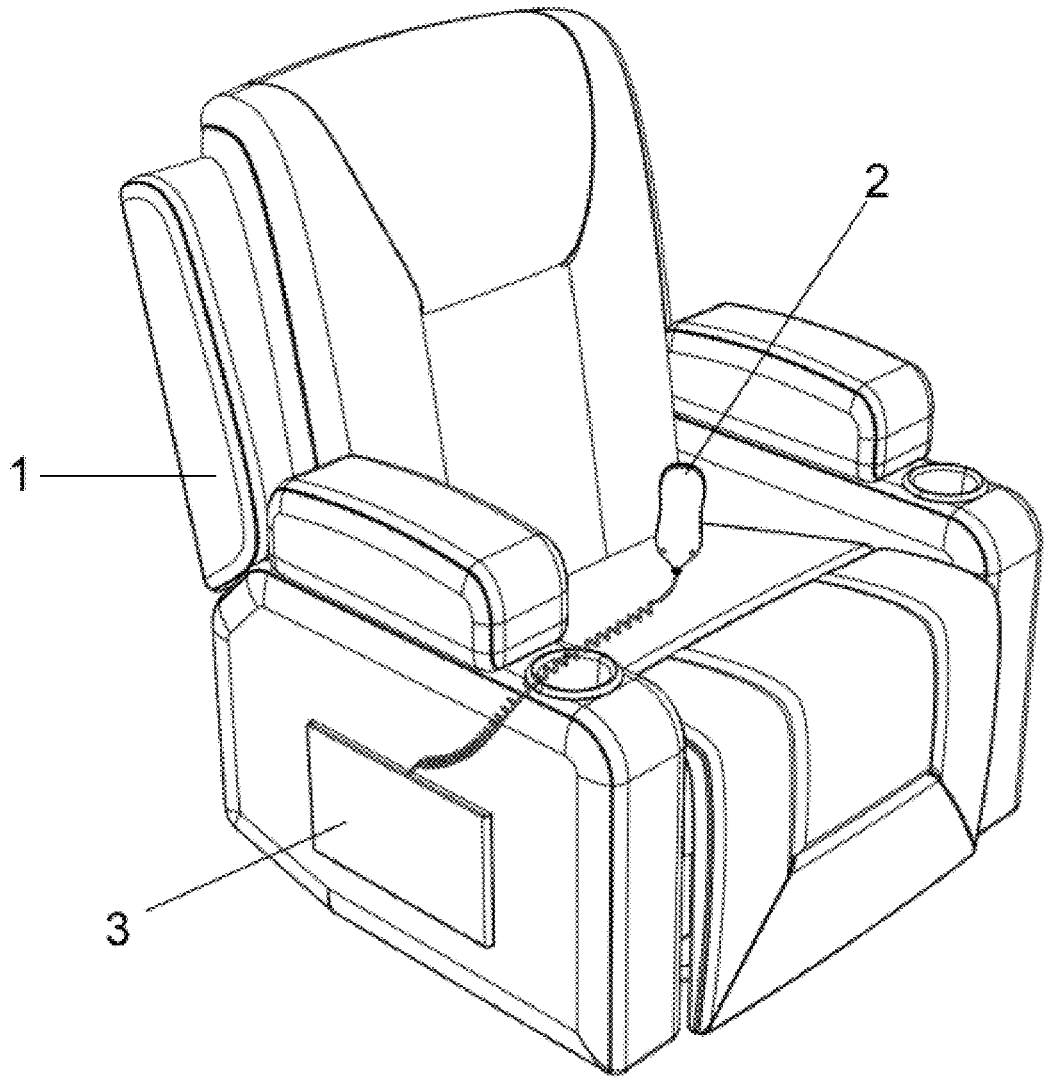
FIG. 2 is a structural diagram of the seat that is specifically a sofa.
Figure 3:
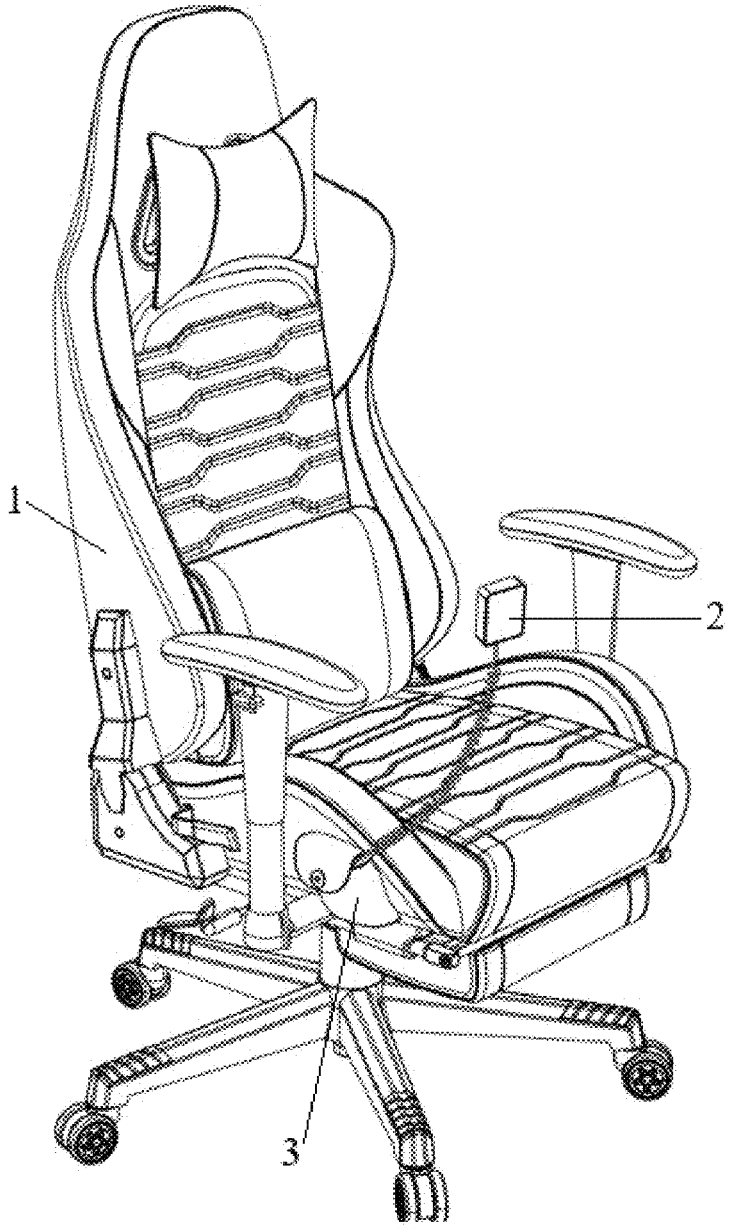
FIG. 3 is a structural diagram of the seat that is specifically a chair.

As shown in FIGS. 1 to 3, this embodiment provides a seat with a health monitoring function. The seat includes: seat body 1, seat power supply box 2, and detection module 25. The seat body 1 is provided with the seat power supply box 2. The seat power supply box 2 is provided with the detection module 25. The seat body 1 is provided with seat pocket 3. The seat power supply box 2 in a storage state is placed in the seat pocket 3. When in use, the seat power supply box 2 is taken out from the seat pocket 3, and a finger is placed at a monitoring position of the seat power supply box 2 for health monitoring. As shown in FIG. 3, when the seat body 1 is a chair, the seat power supply box 2 is a speaker power supply box provided on the chair. As shown in FIG. 2, when the seat body 1 is a sofa, the seat power supply box 2 is a controller provided on the sofa.

Figure 4:
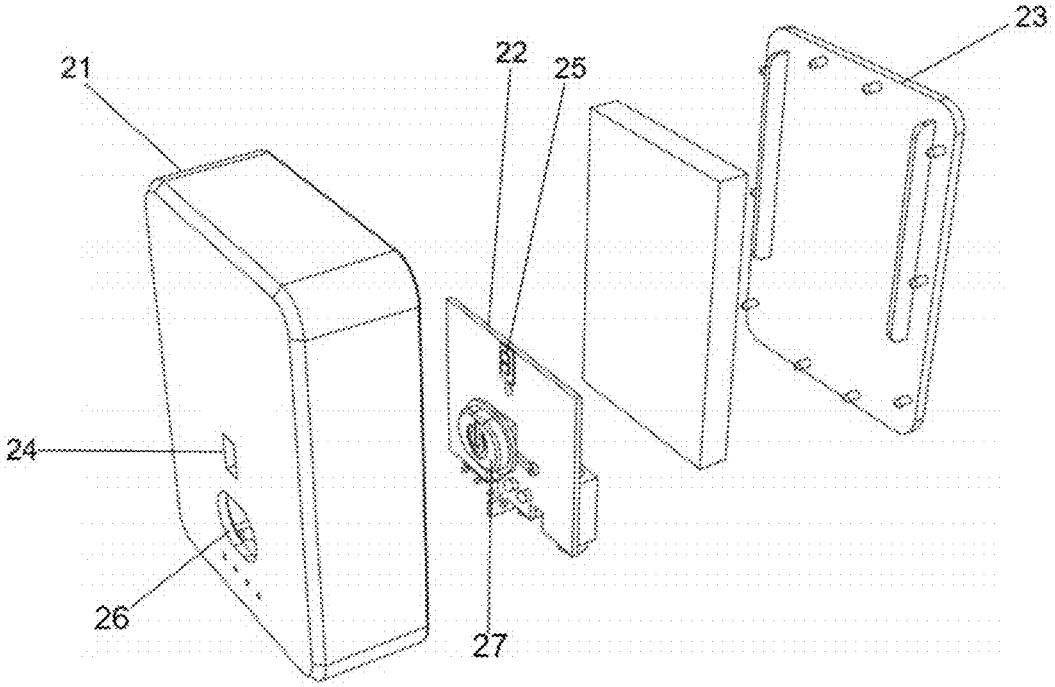
FIG. 4 is a structural diagram of a seat power supply box.

As shown in FIG. 4, the seat power supply box 2 includes: power supply box housing 21, chip and motherboard module 22, power supply box base plate 23, detection hole 24, detection module 25, button hole 26, and control button 27. The power supply box housing 21 is connected to the power supply box base plate 23 and forms a chamber therein. The chip and motherboard module 22 is provided in the chamber. The detection module 25 and the control button 27 are arranged on the chip and motherboard module 22. The power supply box housing 21 is provided with the detection hole 24 and the button hole 26. The detection module 25 and the control button 27 are facing the detection hole 24 and the button hole 26, respectively. The detection hole 24 is located in a center of the seat power supply box 2, making it convenient for the finger to touch and monitor. The chip and motherboard module 22 is connected to a power supply of the seat body 1.

Figure 5:
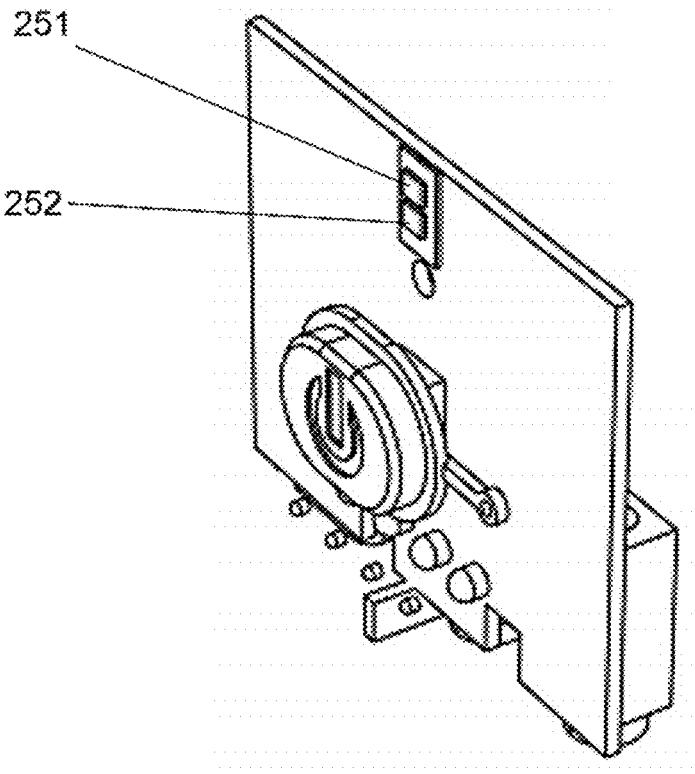
FIG. 5 is a structural diagram of a chip and motherboard module.

As shown in FIG. 5, the detection module 25 is provided with light source 251 and light source sensor 252. A specific working process of the detection module 25 is as follows. With the periodic contraction and relaxation of the heart, blood is transported to various positions in the body through arteries, and a surface capillary also undergoes periodic contraction and relaxation. These weak signals are acquired by a photoelectric induction means, and the information is restored through a signal reduction method to acquire pulse waves. When the finger extends into the detection hole 24, the light source 251 emits a set of infrared light with a specific wavelength onto a capillary. Through a subtle capillary pulsation, the infrared light is reflected onto the light source sensor 252. The light source sensor 252 transmits waveband and frequency data of the received infrared light through the chip and motherboard module 22 to a corresponding device for analysis to obtain a detection result.

In the description of the present application, it needs to be understood the orientation or positional relationships indicated by terms, such as "up", "down", "front", "rear", "left", "right", "vertical", "horizontal", "top", "bottom", "inside", and "outside", are based on the orientation or positional relationship shown in the drawings, are merely for facilitating the description of the present application and simplifying the description, rather than indicating or implying that an apparatus or element referred to must have a particular orientation or be constructed and operated in a particular orientation, and therefore shall not be interpreted as limiting the present application.

The specific embodiments of the present disclosure are described as above. It should be understood that the present disclosure is not limited to the above specific implementations. Those skilled in the art can make various changes or modifications within the scope of the claims, which does not affect the essence of the present disclosure. The embodiments of the present disclosure and features in the embodiments may be arbitrarily combined with each other in a non-conflicting situation.

What is claimed is:

1. A seat with a health monitoring function, comprising a seat body, a seat power supply box, and a detection module, wherein the seat body is provided with the seat power supply box, and the seat power supply box is provided with the detection module;

the seat power supply box comprises: a power supply box housing, a chip and motherboard module, and a power supply box base plate; and the power supply box housing is connected to the power supply box base plate and forms a chamber therein; the chip and motherboard module is provided in the chamber; and the detection module is provided on the chip and motherboard module.

2. The seat with the health monitoring function according to claim 1, wherein the power supply box housing is provided with a detection hole; and the detection module is facing the detection hole.

3. The seat with the health monitoring function according to claim 2, wherein the detection hole is located in a center of the seat power supply box.

4. The seat with the health monitoring function according to claim 1, wherein the seat body is provided with a seat pocket; and the seat power supply box in a storage state is placed in the seat pocket.

5. The seat with the health monitoring function according to claim 1, wherein the chip and motherboard module is connected to a power supply of the seat body.

6. The seat with the health monitoring function according to claim 1, wherein the detection module is provided with a light source and a light source sensor; and light emitted by the light source to a capillary is reflected to the light source sensor through a capillary pulsation.

7. The seat with the health monitoring function according to claim 1, wherein when the seat body is a chair, the seat power supply box is a speaker power supply box provided on the chair; and when the seat body is a sofa, the seat power supply box is a controller provided on the sofa.

8. The seat with the health monitoring function according to claim 1, wherein the power supply box housing is provided with a button hole; the chip and motherboard module is provided with a control button; and the control button is facing the button hole.

9. A seat with a health monitoring function, comprising a seat body, a seat power supply box, and a detection module, wherein the seat body is provided with the seat power supply box; and the seat power supply box is provided with the detection module;

the seat power supply box comprises: a power supply box housing, a chip and motherboard module, and a power supply box base plate;

the power supply box housing is connected to the power supply box base plate and forms a chamber therein; the chip and motherboard module is provided in the chamber; the detection module and a control button are provided on the chip and motherboard module; the power supply box housing is provided with a detection hole and a button hole; the detection module and the control button are facing the detection hole and the button hole, respectively; and the detection hole is located in a center of the seat power supply box;

the detection module is provided with a light source and a light source sensor; and light emitted by the light source to a capillary is reflected to the light source sensor through a capillary pulsation;

the seat body is provided with a seat pocket; the seat power supply box in a storage state is placed in the seat pocket; and the chip and motherboard module is connected to a power supply of the seat body; and when the seat body is a chair, the seat power supply box is a speaker power supply box provided on the chair; and when the seat body is a sofa, the seat power supply box is a controller provided on the sofa.

* * * * *